United States Patent [19]

Singh et al.

[11] Patent Number: 4,980,972

[45] Date of Patent: Jan. 1, 1991

[54] METHOD OF MAKING A CONDUCTOR FOR A HIGH ENERGY DENSITY HYPERCONDUCTING INDUCTOR

[75] Inventors: Sharad K. Singh, Pittsburgh; Donald T. Hackworth, Monroeville Boro, Allegheny County, both of Pa.

[73] Assignee: Westinghouse Electric Corp., Pittsburgh, Pa.

[21] Appl. No.: 405,715

[22] Filed: Sep. 11, 1989

Related U.S. Application Data

[62] Division of Ser. No. 67,342, Jun. 29, 1987, Pat. No. 4,912,446.

[51] Int. Cl.[5] ..... H01R 43/00

[52] U.S. Cl. ..... 29/872; 29/599; 29/605; 29/825; 174/15.5; 336/62

[58] Field of Search ..... 29/599, 602.1, 605, 29/868–872, 825; 174/15.5, 15.6, 125.1, 128.1; 336/62

[56] References Cited

U.S. PATENT DOCUMENTS

| | | | |
|---|---|---|---|
| 3,657,466 | 4/1972 | Woolcock et al. | 174/125.1 X |
| 4,254,299 | 3/1981 | Horvath et al. | 174/15.5 |
| 4,409,425 | 10/1983 | Ries | 174/125.1 X |

*Primary Examiner*—Carl E. Hall

*Attorney, Agent, or Firm*—M. G. Panian

[57] ABSTRACT

A cryogenically coolable inductive coil including: a multicomponent conductor comprising a plurality of components, each component including a cable of conductive material having a longitudinal axis about which the cable is twisted, the cable being wrapped helically and being compacted, after wrapping, to minimize voids in the cable and to give the component a polygonal profile, the components being disposed parallel, and adjacent, to one another with mutually facing sides of adjacent components being in contact with one another; and an electrical insulating and support structure at least partially surrounding the conductor for supporting stresses induced in the conductor due to magnetic fields created by the flow of current through the conductor, the conductor and the structure being wound to form the coil.

6 Claims, 2 Drawing Sheets

METHOD OF MAKING A CONDUCTOR FOR A HIGH ENERGY DENSITY HYPERCONDUCTING INDUCTOR

This is a division of application Ser. No. 07/067,342 filed June 29, 1987, now U.S. Pat. No. 4,912,446.

BACKGROUND OF THE INVENTION

The present invention relates to a hyperconducting inductor, or coil, capable of establishing high energy density inductive fields.

Proposed satellite-borne systems, such as electromagnetic launchers, lasers and particle beam generators, will require power levels as high as a few gigawatts in the form of pulses having a duration of a few microseconds and produced with repetition frequencies of between several Hz and several kHz. The peak power requirement for the primary electrical supply of such a system can be reduced by the utilization of inductive energy storage technology.

For example, if an energy storage inductor can be charged with energy over a period of 0.1 sec. or longer, the average power required from the primary electrical supply can be set in the multimegawatt range, permitting a reduction in the overall weight of the satellite-borne power system.

In order for inductive energy storage to be utilized for this purpose in a satellite-borne system, the inductor must be capable of conducting high current levels and establishing high energy densities, while being efficient, light in weight and reliable.

SUMMARY OF THE INVENTION

It is an object of the present invention to provide an inductor having the above-mentioned characteristics and thus well suited for use in a satellite-borne high power system, or other system requiring a combination of high power output and low weight.

The above and other objects are achieved, according to the invention, by a cryogenically coolable inductive coil comprising: a multicomponent conductor comprising a plurality of components, each component including a cable of conductive material having a longitudinal axis about which the cable is twisted, the cable being wrapped helically and being compacted, after wrapping, to minimize voids in the cable and to give the component a polygonal profile, the components being disposed parallel, and adjacent, to one another with mutually facing sides of adjacent components being in contact with one another; and an electrical insulating and support structure at least partially surrounding the conductor for supporting stresses induced in the conductor due to magnetic fields created by the flow of current through the conductor, the conductor and the structure being wound to form the coil.

If an orbiting system includes, in order to satisfy various system requirements, a fluid, such as hydrogen, which can serve as a cryogenic fluid, the use of a cryogenic inductive energy storage device can help to maximize the overall weight utilization efficiency of the system.

Theoretical analysis reveals that a hyperconducting inductive device i.e. a device maintained at an operating temperature of the order of 20° K., would be significantly lighter, and would achieve higher energy densities, than a superconducting device, without the added penalty of requiring a helium refrigeration system, and this would result in improved reliability for the overall system.

DESCRIPTION OF THE PREFERRED EMBODIMENTS

Figure 1:
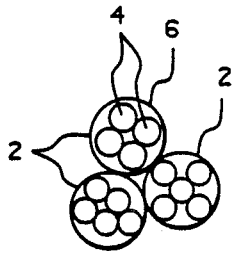
FIG. 1 is an end view of a cable forming a component of conductors according to the invention.

The initial phase in the manufacture of an inductor according to the present invention is illustrated in FIG. 1 which shows a cable or braid composed of a plurality of strands 2 which are twisted together to form the cable. Strands 2 are twisted in such a manner as to form a fully transposed cable, i.e. all strands 2 are twisted by an identical amount so that all twisted strands have the same pitch and over the length of one full cable twist each strand is twisted through an angle of 360°. This uniform twisting assures that all strands will have the same resistance and stress loading. Each strand 2 is composed of a plurality of, e.g. 10, high purity aluminum filaments 4, each up to a few mm in diameter, enclosed by a high strength aluminum tube 6, the dimensions of filaments 4 and tube 6 being selected such that, for example, filaments 4 constitute 60 percent of the strand and tube 6 constitutes 40 percent of the strand, by weight. Tube 6 can be of any suitable aluminum alloy selected to provide the desired strength characteristics.

To form a strand 2, filaments 4 are inserted into aluminum tube 6, with filaments 4 possibly twisted together, and the resulting assembly is subjected to one or more drawing operations which reduce the diameter of tube 6 and minimize the voids present at the interior of tube 6. Preferably, each drawing operation is followed by a standard heat treatment selected to restore the original conductivity characteristics of the aluminum material.

A plurality of the resulting strands 2 are then formed into the twisted cable, after which the cable can be subjected to one or more drawing operations to reduce its diameter and eliminate or reduce voids. A further standard heat treatment can be carried out to restore conductivity characteristics after each drawing operation. The resulting twisted cable may then, according to one embodiment of the invention, be wrapped helically around an aluminum cooling tube 10, which can be of rectangular or square cross section, after which the wrapped cable is subjected to a further drawing operation which reduces the lateral dimensions of the unit, further compacts the coil, and gives the resulting conductor component 12 a square or rectangular cross section. Normally, this further drawing operation will not significantly reduce the cross section of tube 10. After the last compacting operation, the cross section of conductor component 12 preferably has, exclusive of the interior of tube 10, a void content of the order of about 5% or less. Tube 10 is made of a high strength aluminum alloy similar to that employed for each of tubes 6.

A typical component 12 may measure 3 to 13 mm on a side and tube 10 may measure up to 3 mm on a side in typical embodiments of the invention.

The various drawing operations can be performed using compression rollers and after the component 12 of square cross section has been formed, it can be subjected to a further heat treatment to restore conductivity characteristics. A heat treatment can also be carried out before subjecting the wrapped cable to a drawing operation.

Figure 2:
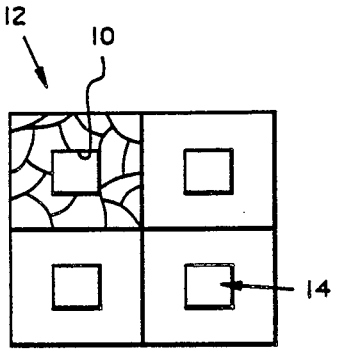
FIG. 2 is an end view of a conductor according to the invention.

Thereafter, four components 12 are placed together to form the coil conductor shown in FIG. 2, where the interior of each aluminum tube 10 defines a cryogenic coolant flow channel 14.

The resulting conductor shown in FIG. 2 will have significantly lower pulse losses than, but approximately the same mechanical strength as, a monolithic conductor of similar dimensions. Moreover, the division of the conductor into four assemblies 12 not only reduces the resulting winding strain by a factor of 4, but also facilitates the subsequent coil forming operation and reduces the extent of conductor keystoning. These advantages are achieved at the expense of a slight, but acceptable, increase in the pumping power that will be required to pump coolant through channels 14. If the conductor were further subdivided into a larger number of assemblies, the advantage gained because of further reductions in winding strain would be more than offset by the required increase in pumping power.

The resulting conductor is then placed within a support and insulating structure 18 of U-shaped cross section. Structure 18 is preferably made of several layers 20 of a fibrous material, such as fiberglass mat, with fibers having a preferred orientation which extends essentially n the circumferential direction of the conductor, as indicated by the broken lines in FIG. 3. Structure 18 is constructed to have a high strength, particularly in the vertical direction of FIG. 3, a high modulus of elasticity and a low bulk density. The thickness of structure 18 can be adjusted by varying the number of layers 20 employed.

Figure 3:
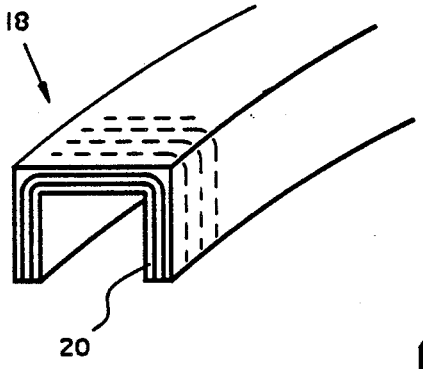
FIG. 3 is a perspective view of a support and insulating structure forming a component of a coil according to the invention.

A length of the conductor shown in FIG. 2, enclosed by the structure 18 of FIG. 3, is then wound to form an inductor coil. Structure 18 is dimensioned to press components 12 laterally against one another. Nevertheless, a certain freedom of movement exists between components 12 so that during the winding operation components 12 can slide relative to one another. This helps to reduce conductor strain and the keystoning mentioned above.

Figure 4:
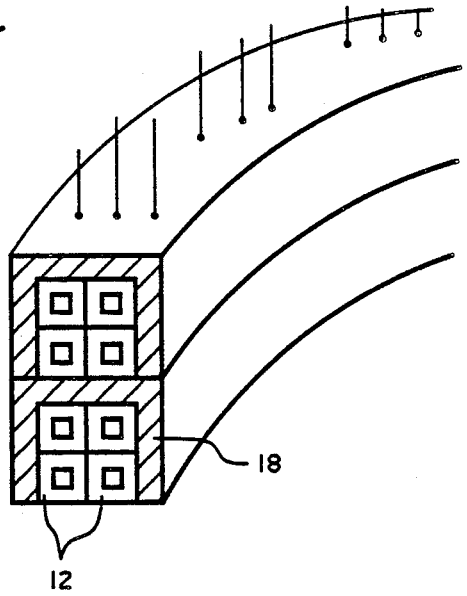
FIG. 4 is a perspective view of a portion of a coil according to the invention.

According to a preferred embodiment of the invention, the coil is a single layer solenoid consisting of, for example, ten turns, the coil having the form of a cylinder, two adjacent turns of which are shown in FIG. 4. The vertical arrows directed to the top surface of the coil structure shown in FIG. 4 illustrate the axial loading which is supported by structure 18.

As is shown in FIG. 4, the vertical legs of the portion of structure 18 associated with each coil turn bear upon the horizontal base of the portion of structure 18 associated with the underlying coil turn. Thus magnetically induced stresses are transferred to, and supported by, structure 18.

To produce one preferred embodiment of an inductor according to the present invention, a plurality of such coils, each having a respectively different diameter, are formed, and the coils are then nested one within the other, in the form of shells, to form the resulting inductor structure. Such solenoid geometry is preferred because it represents the most efficient configuration in terms of both energy/volume ratio and energy/mass ratio.

Figure 5:
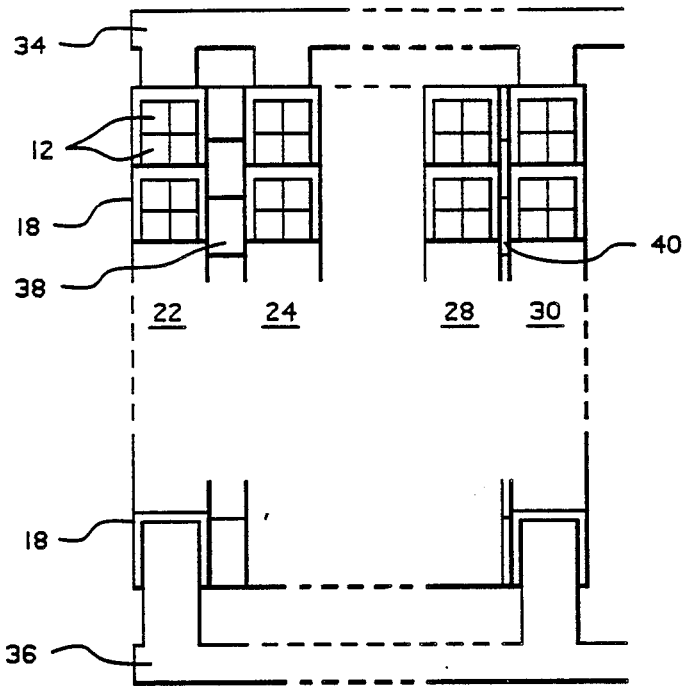
FIG. 5 is a diagrammatic cross-sectional view of an inductor according to the invention.

One embodiment of such an inductor structure is shown in FIG. 5, where a group of, e.g. 10, nested solenoid coils has the geometry of a Brooks coil, which will maximize the energy stored for a given length of conductor. The individual, radially spaced axial, or solenoid, coils 22, 24, . . . 28, 30 are nested within one another and are connected in parallel by means of headers 34 and 36 which constitute current connectors and conduits via which cryogenic coolant is circulated through channels 14. An inductor having this form is compact, and permits the highest possible energy density and conductor pulse loss efficiency. At the same time, such a structure can limit conductor strain to less than 0.1 percent.

The distributed structure shown in FIG. 5 can be fabricated in such a manner as to provide a low combined value of winding, structure fabrication, cooldown and operational strain on the conductors. At the same time, this structural configuration makes optimum use of the materials employed and minimizes the coil mass.

Each conductor can be connected to each header by an appropriate metallurgical bonding operation, such as soldering or welding.

A coil as shown in FIG. 5 can be constructed to have an inductance of 190 $\mu$H, to conduct a peak current of 2 MA(megamps), which a stored energy of 420 MJ, a peak voltage of 20 kV and a maximum current drop less than or equal to 20 percent.

As noted above, axial loading on the coils is supported by structures 18, while radial support is provided by a plurality of radial supporting rings 38, 40, which can be of a composite material similar to that employed for support members 18.

Each radial support ring 38, 40 can be manufactured as a strip composed of graphite fibers coated with an epoxy resin the strip being wound helically about its associated coil during manufacture of an inductor. A starting strip made of graphite fibers can be immersed in a mass of epoxy resin in liquid form and then wrapped around the associated coil before the resin is set and while the resin is still partially in the liquid state. Setting of the epoxy is then completed after the strip has been placed in the form of a ring.

In operation, the radial stresses will be greater at the inner periphery of the inductor, bordered by coil 22, than at the outer periphery, defined by coil 30. In order to adequately support these stresses, while maintaining the inductor as compact as possible, the thickness, i.e. the radial dimension, of radial support rings 38, 40 is varied progressively in that the ring 38 adjacent coil 22 has a maximum thickness and the ring 40 adjacent coil 30 has a minimum thickness. In each case, the thickness is selected, on the basis of the ring composition, to provide the radial support needed in that region of the inductor.

It should be apparent that coils according to the present invention can be given other inductor configurations, such as various types of toroids, depending on circuit requirements.

In addition, while reference has been made above to the use of aluminum for the conductor structures, copper or other materials could also be employed, although aluminum and copper are presently believed to be the most suitable materials.

The resistivity which such materials can have at low temperatures is significantly influenced by their purity. Since, however, high purity materials have a relatively low mechanical strength, satisfactory inductors must include support members having sufficient mechanical strength. Tubes 6 and axial and radial supports 18, 38, 40 described above can perform this function in a highly effective manner.

The conductors of coils according to the invention can have their compacted conductive material and cooling channel arranged in various ways which differ from that shown in FIGS. 2 and 4. Two exemplary alternative possibilities are shown in FIGS. 6 and 7.

Figure 6:
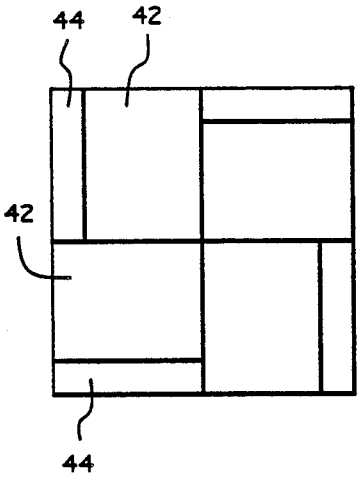
FIGS. 6 and 7 are views similar to that of FIG. 2 relating to further embodiments of the invention.
Figure 7:
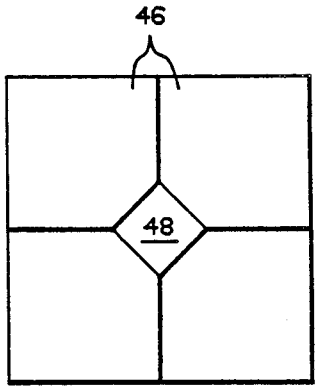

In FIG. 6, each component is composed of a helically wrapped, compressed cable 42 alongside a cooling channel 44, while in FIG. 7, four such cables 46 surround a common cooling channel 48. These embodiments offer reduced coolant flow resistance, which is desirable in the case of smaller conductor cross sections.

According to other embodiments of the invention, the coolant flow channels can be eliminated altogether and the entire coil can be immersed in coolant.

It will be understood that the above description of the present invention is susceptible to various modifications, changes, and adaptations, and the same are intended to be comprehended within the meaning and range of equivalents of the appended claims.

What is claimed is:

1. A method of making a conductor which is coilable to form a cryogenically cooled inductor, comprising:

forming a strand by placing a plurality of filaments of a high purity elemental metal into a high strength tube of a material containing the same elemental metal;

forming a cable by twisting together a plurality of such strands;

wrapping the cable helically around a second tube constituting a coolant flow channel;

laterally compacting the wrapped cable to form a conductor component having a polygonal profile; and disposing a plurality of such components parallel, and adjacent, to one another with mutually facing sides of adjacent components in contact with one another.

2. A method as defined in claim 1 further comprising, after said step of forming a strand and before said step of forming a cable, laterally compacting the strand.

3. A method as defined in claim 2 further comprising, after said step of laterally compacting the strand and before said step of forming a cable, subjecting the strand to a heat treatment for restoring the electrical conductivity characteristics of the strand.

4. A method as defined in claim 1 further comprising, after said step of forming a cable and before said step of wrapping the cable, laterally compacting the cable.

5. A method as defined in claim 4 further comprising, after said step of laterally compacting the cable and before said step of wrapping the cable, subjecting the cable to a heat treatment for restoring the electrical conductivity characteristics of the cable.

6. A method as defined in claim 1 further comprising, after said step of laterally compacting the wrapped cable, subjecting the component to a heat treatment for restoring the conductivity characteristics of the component.

* * * * *